US005647906A

United States Patent [19]

Monday et al.

[11] Patent Number: 5,647,906

[45] Date of Patent: Jul. 15, 1997

[54] PIPE CLEANING MACHINE

[75] Inventors: John W. Monday, Dayton; Joseph C. Ottaviani, Kingwood; Leonard R. Smith, Dayton, all of Tex.

[73] Assignees: A-Z Terminal Corporation, Tulsa, Okla.; Leonard Smith, Dayton, Tex.; a part interest

[21] Appl. No.: 851,688

[22] Filed: Mar. 11, 1992

[51] Int. Cl.[6] ..... B05C 13/00

[52] U.S. Cl. ..... 118/70; 118/307; 118/309; 118/326; 118/DIG. 11; 118/DIG. 10; 118/317; 15/88; 15/104.04; 210/512.3

[58] Field of Search ..... 15/104.4, 88, 23; 55/DIG. 46; 118/307, 309, 317, 326, DIG. 10, DIG. 11, 70; 210/512.3

[56] References Cited

U.S. PATENT DOCUMENTS

| | | | |
|---|---|---|---|
| 2,436,099 | 2/1948 | Cummings et al. | 15/104.04 |
| 2,763,236 | 9/1956 | Cummings | 118/DIG. 11 |
| 3,120,460 | 2/1964 | Schell | 118/DIG. 11 |
| 3,438,078 | 4/1969 | Muselaers | 15/88 |
| 3,447,177 | 6/1969 | Williams et al. | 15/23 |
| 3,495,288 | 2/1970 | Ford | 15/88 |
| 3,530,526 | 9/1970 | Schmidt | 15/302 |
| 3,641,608 | 2/1972 | Kratt | 15/88 |
| 3,764,008 | 10/1973 | Darley et al. | 210/512.2 |
| 3,797,060 | 3/1974 | Salukvadze et al. | 15/88 |
| 3,820,184 | 6/1974 | Stone | 15/104.04 |
| 3,895,463 | 7/1975 | Brandli et al. | 51/87 R |
| 4,124,914 | 11/1978 | Buzhinsky et al. | 15/93 R |
| 4,156,949 | 6/1979 | Ziegelmeyer | 15/88 |
| 4,166,301 | 9/1979 | Smith | 15/88 |
| 4,441,238 | 4/1984 | Hijuelos et al. | 29/33 D |
| 4,665,657 | 5/1987 | Rands et al. | 51/103 TF |
| 4,704,986 | 11/1987 | Remp et al. | 118/317 |
| 4,734,950 | 4/1988 | Schenke et al. | 15/88 |
| 4,744,123 | 5/1988 | Le Testu et al. | 15/104.04 |
| 4,771,499 | 9/1988 | Fusi et al. | 15/88 |
| 4,823,731 | 4/1989 | Howeth | 55/DIG. 46 |
| 4,966,177 | 10/1990 | John, Jr. et al. | 134/61 |
| 4,987,001 | 1/1991 | Knobbe et al. | 118/317 |
| 5,001,801 | 3/1991 | Jarvis et al. | 15/93.1 |
| 5,005,245 | 4/1991 | Dooley et al. | 15/104.04 |
| 5,153,028 | 10/1992 | Shutic et al. | 55/DIG. 46 |

*Primary Examiner*—John Hoffmann
*Attorney, Agent, or Firm*—Head, Johnson & Kachigian

[57] ABSTRACT

An environmentally compatible pipe cleaning station having an elongated incoming pipe feeder for receiving a length of pipe thereon to be cleaned, a cleaning station through which the pipe is axially and rotationally advanced onto an elongated pipe receiving system that is in axial alignment with the incoming pipe feeder and which then axially passes the length of pipe back through the cleaning station, an elongated secondary pipe feeder system adjacent the incoming pipe feeder lateral transfer apparatus for moving the cleaned pipe onto an adjacent paralleled secondary pipe feeder, a coating booth in axial alignment with the secondary pipe feeder through which a length of pipe is fed and is spray coated, and an outgoing pipe receiver system in alignment with a secondary pipe feeder for receiving the cleaned and coated pipe which is ready to be removed for storage. The cleaning station and coating booth are each environmentally secured, the cleaning station employing a cyclone separator for collecting materials, such as dirt, rust and so forth, removed from the exterior of the pipe in the cleaning process, and the coating booth having filters therein through which air passes prior to escaping to the environment.

8 Claims, 3 Drawing Sheets

PIPE CLEANING MACHINE

BACKGROUND OF THE INVENTION

In the petroleum as well as other industries, it is common to make use of metal pipe that has been in previous use. Most pipe utilized in the petroleum and other industrial applications is made of steel. Steel is the preferred metal because of its economy and strength. However, steel pipe rusts and is prone to develop scales on the outer surface.

To protect the pipe from corrosion it is normally desirable that the pipe be coated with a protective cover to substantially increase its useful life. Before a new protective cover can be applied to the exterior of the pipe it must be thoroughly cleaned. The normal means of cleaning a pipe is to advance a length of pipe axially past rotating brushes that contact the exterior of the pipe at high speed to dislodge dirt, rust, scale and so forth. One problem that exists with this method of cleaning pipe is that it generates a large quantity of dust that can be carried away by the air. Thus, the dirt and contamination removed from the exterior of a pipe during cleaning operations tends to infiltrate the air and thereby are considered to be an environmental hazard.

Another problem with the heretofore utilized procedures for cleaning and repainting or recovering pipe is that the spray process typically employed for applying a coating onto the pipe exterior surface tends to spray coating droplets and vapors into the atmosphere that also are deemed to be an environmental hazard.

In the past, not much concern has been given to the pollution of the atmosphere that can occur in the process of cleaning and recoating pipe, but in modern times society is much more cognizant of deterioration of our environment and particularly in air quality. As a consequence, increased interest has developed in providing means of cleaning and recoating pipe in a manner that is environmentally compatible. Therefore it is an object of this disclosure to provide an improved and environmentally compatible pipe cleaning station.

For background reference relating to methods, systems and apparatuses employed in cleaning pipe, reference may be had to the following U.S. Pat. Nos.: 2,436,099; 3,438,078; 3,641,608; 3,447,177; 3,495,288; 3,530,526; 3,797,060; 3,820,184; 3,895,463; 4,124,914; 4,156,949; 4,166,301;4,441,238; 4,665,657; 4,734,950; 4,744,123; 4,771,499; 4,966,177; 5,001,801; and 5,005,245.

SUMMARY OF THE INVENTION

An environmentally compatible pipe cleaning station is the subject of this disclosure. The station, which can be portable so as to be easily moved from one location to another such as is highly desirable in the oil industry, includes an elongated incoming pipe feeder for receiving lengths of pipe thereon to be cleaned. The pipe feeder is of a length equal to the maximum length of metal pipe, and particularly steel, encountered in the industry. The incoming pipe feeder has rollers arranged for axially advancing while simultaneously rotating the pipe that is placed on it. An environmentally secure cleaning station is positioned in axial alignment with the incoming pipe feeder. The cleaning station includes at least one, but preferably a plurality, of rapidly rotating brushes that engage the exterior of the pipe. As the pipe is advanced axially and simultaneously rotated through the cleaning station, the brushes contact the pipe surface to dislodge rust, scale, dirt and any other foreign material adhered thereto to thereby thoroughly clean the exterior of the pipe.

The rotating brushes that function to dislodge the rust, dirt, scale and so forth, create a large quantity of dust-like particles that otherwise would tend to be disbursed into the atmosphere. The cleaning station of this disclosure is environmentally secure and includes a housing having an opening through which the pipe is axially advanced. A large fan pulls air from the housing and thereby pulls with it the dust, rust, scale and so forth that is dislodged during the cleaning operation. Air laden with this dust-like material is fed into a cyclone separator. In the separator the dust laden air is injected circumferentially and swirls within the separator, causing the dust particles to be expelled outwardly by centrifugal force and passed downwardly within the cyclone separator into lower dust pans wherein the collected dust-like material can be removed for disposal. The air, substantially free of such dust particles, passes upwardly through a stack for discharge into the atmosphere. After a length of pipe has passed through the cleaning station, it moves onto an elongated pipe receiving system that is in axial alignment with the incoming pipe feeder. Thus, the cleaning station is in between the axially aligned incoming pipe feeder and the pipe receiving system. The pipe receiving system first functions to receive the length of pipe after it has fully passed through the cleaning station and then to axially move the pipe back through the cleaning station. In the process of rearwardly axially moving the pipe back through the cleaning station, the pipe can be, and preferably is, cleaned a second time as it passes the rotating brushes to again move onto the incoming pipe feeder. The pipe at this stage has thus been passed forwardly through the pipe cleaning station and rearwardly back through the pipe cleaning station and, therefore, the pipe is now cleaned.

Positioned adjacent and parallel to the elongated incoming pipe feeder is an elongated secondary pipe feeder that is configured to receive a length of clean pipe thereon. By means of actuated arms the cleaned pipe is laterally transferred from the incoming pipe feeder onto the secondary pipe feeder.

Positioned in axial alignment with the secondary pipe feeder is an environmentally secure coating booth. The cleaned pipe is moved through the secondary pipe feeder through the coating booth where a protective coating is sprayed from nozzles onto the exterior surface of the cleaned pipe.

An elongated outgoing pipe receiver system is positioned in axial alignment with the secondary pipe feeder. Thus, the coating booth is in between the aligned secondary pipe feeder and the outgoing pipe receiver system. Pipe that has passed through the coating booth is received on the pipe receiver system where the pipe, having been cleaned and coated, is ready to be removed for storage and subsequent usage.

The coating booth is an enclosure having openings therethrough for the passage of pipe and with spray nozzles therein orientated to spray coating onto the pipe as it passes through. Air is drawn out of the coating booth through an air horn. Positioned between the portion of the coating booth wherein the coating is applied to the pipe and the air horn are filters that function to intercept coating droplets, vapors from the coating, and so forth. Thus, the air passing out of the coating booth is filtered to remove substantially any contaminants that would otherwise pass into the atmosphere from the spraying operation.

Loading arms are typically employed for loading lengths of pipe onto the incoming pipe feeder and, in a similar manner, unloading arms are employed for removing pipe after it has been cleaned and coated from the outgoing pipe receiver system.

Thus, the system of this disclosure provides an environmentally compatible pipe cleaning station for cleaning and coating pipe in a way to minimize the effects on the environment.

A better understanding of the invention will be had with reference to the following description of the preferred embodiment and the claims, taken in conjunction with the attached drawings.

BRIEF DESCRIPTION OF THE DRAWINGS

FIG. 2 thus illustrates the coating booth as employed with the pipe cleaning station of FIG. 1 to prohibit the passage of coating droplets and vapors into the atmosphere.

DESCRIPTION OF THE PREFERRED EMBODIMENT

Figure 1:
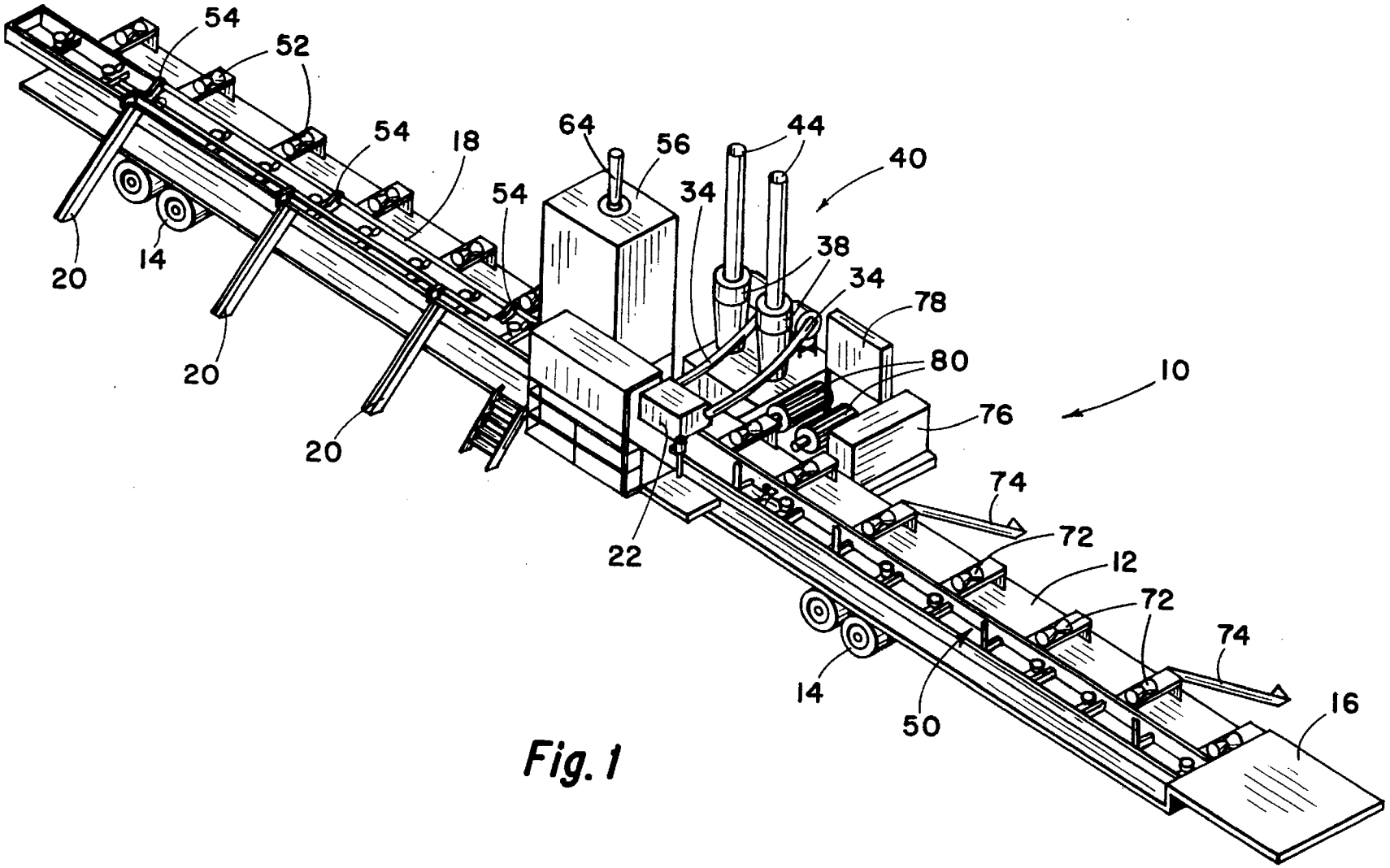
FIG. 1 is an isometric view of an environmentally compatible pipe cleaning system that incorporates the principles of this disclosure. The pipe cleaning station of FIG. 1 may be arranged to be portable so that it can be easily moved from one location to another.

Referring to the drawings and first to FIG. 1, an embodiment of an environmentally compatible pipe cleaning station of this disclosure is generally indicated by the numeral 10. The pipe cleaning station includes a platform or structural frame work 12 that, as illustrated, may be provided with wheels 14 so that the platform can be easily moved from one location to another. Extending tongue portion 16 may be employed such as for a fifth wheel-like connection to a towing vehicle. The platform structure 12 is illustrative only and can take many forms and have many different appearances. Further, this disclosure is not limited to a portable system and, if desired, the principles of this disclosure may be utilized equally as well for construction of a stationarily mounted pipe cleaning system.

Mounted onto platform 12 is an elongated incoming pipe feeder 18. The pipe feeder 18 is of a length sufficient to receive the longest length of metal pipe for which the system is designed. The incoming pipe feeder has rollers, as illustrated, that serve when actuated to axially advance and simultaneously rotate pipe positioned thereon. Loading arms 20 are illustrative of devices used for loading pipe onto incoming pipe feeder 18.

Figure 3:
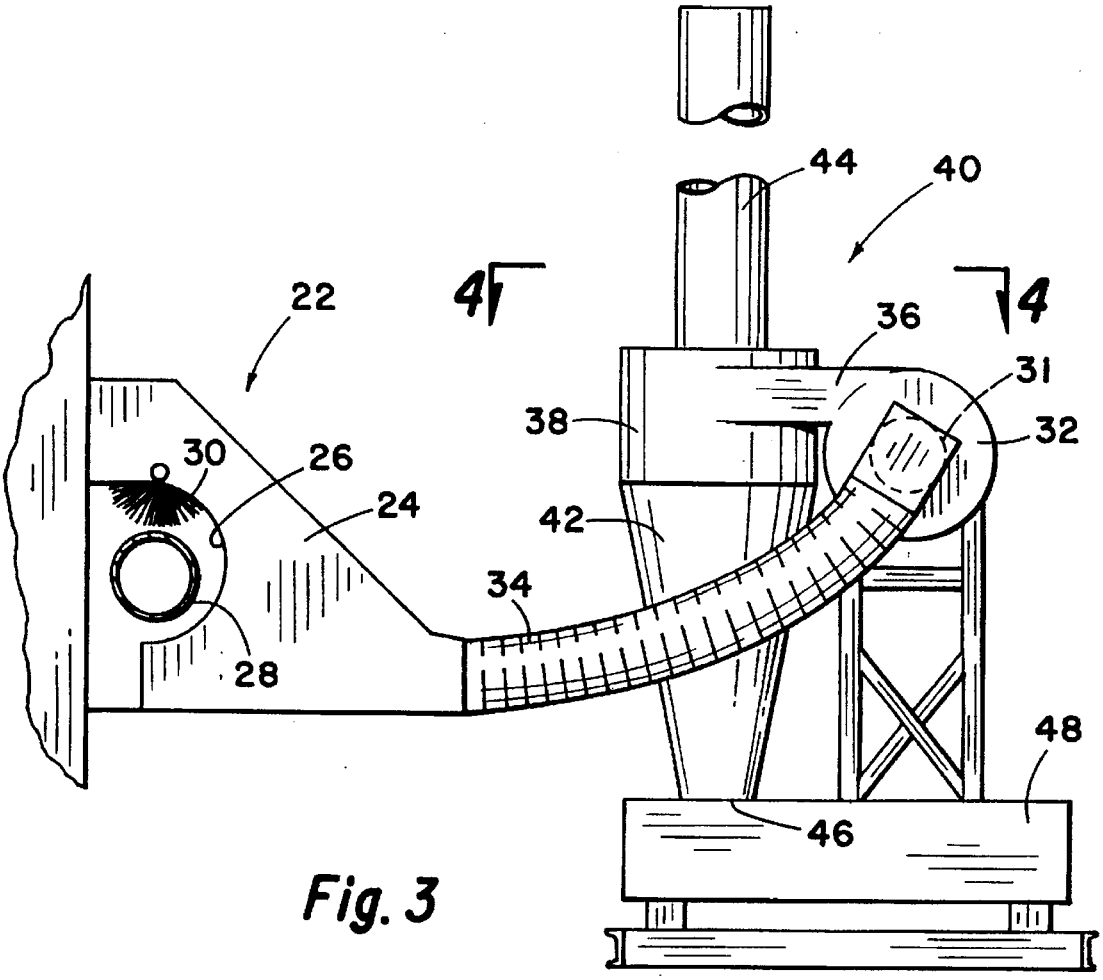
FIG. 3 is an end view of the dust hood in which the cleaning of the pipe exterior surface occurs and an elevational view of a cyclonic separator system wherein the dust, dirt, scale and so forth, that are removed from the pipe exterior surface are separated and collected in the cyclonic separator so as to prevent this dust-like material from permeating the atmosphere.
Figure 4:
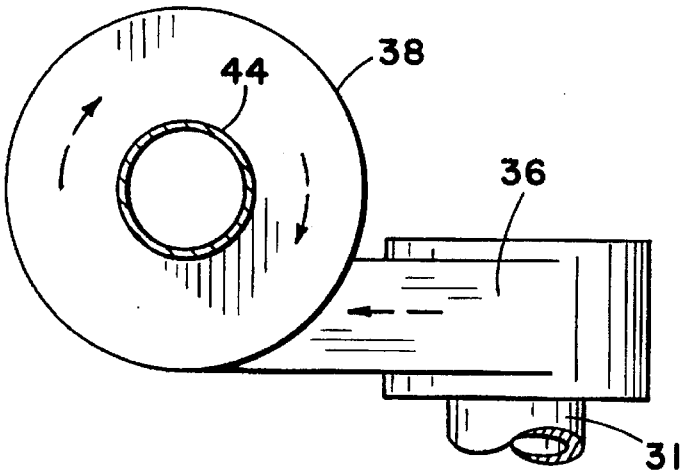
FIG. 4 is a cross-sectional view taken along the line 4—4 of FIG. 3 looking down on the cyclone separator showing the relationship between the fan and the cyclone separator by which air bearing the dust-like material removed from the pipe exterior surface is introduced into the cyclone in a circumferential manner to cause the dust laden air to swirl and separate the dust particles from the air before the air is discharged to the atmosphere.

Positioned in axial alignment with incoming pipe feeder 18 is a cleaning station 22 that is illustrated in more detail in FIG. 3. Cleaning station 22 includes a dust hood 24 having opposed openings 26 therein (only one of which is seen) thorough which pipe 28 passes. The pipe 28 passes through openings 26 of dust hood 24 as the pipe is axially advanced by and off of incoming pipe feeder 18 as previously described.

The cleaning station 22 includes at least one rotating brush 30 but may include a plurality of brushes. Brush 30 rapidly rotates and has bristles that engage the exterior surface of pipe 28 to dislodge dirt, rust and the like that typically adheres to metal pipe used in industry, and particularly as employed in the petroleum industry. As previously mentioned, pipe 28 is rotated as it is axially advanced by incoming pipe feeder 18 so that all portions of the exterior surface of the pipe are contacted by brush 30, or brushes if more than one is employed, to thoroughly clean the entire circumferential surface of the pipe.

This cleaning operation inherently produces large quantities of dust-like material that would otherwise be discharged into the atmosphere. By the provision of dust hood 24 the dust is confined. A fan 32 has a conduit 34 extending to dust hood 24. The fan pulls a large volume of air through openings 26 into the dust hood and by which the dust-like particles that are dislodged from the pipe surface are carried. That is, the air pulled through conduit 34 picks up and moves the dust-like material dislodged from the surface of pipe 28 and since fan 32, by way of conduit 34, pulls a vacuum on dust hood 24 the possibility of escape of any dust-like particles out of the dust hood through openings 26 is substantially eliminated. Air laden with the dust-like particles is expelled by fan 32 through fan outlet 36 into the upper cylinder portion 38 of a cyclonic separator, cyclonic separator being generally indicated by the numeral 40. Affixed below cylinder portion 38 is a frustoconical portion 42. Extending upwardly out of a central opening of cylinder portion 38 is an exhaust stack 44.

The lower end 46 of cyclonic separator frustoconical portion 42 connects with a dust pan 48.

The function of cyclone separator 40 is to separate the solid particles, that is, the dust-like particles, removed from the surface of the pipe from the air. This is accomplished by centrifugal force within the separator. The dust laden air is introduced circumferentially to whirl at a high velocity within the separator. The heavier dust particles settle downwardly through the lower frustoconical portion and into dust pan 48. The air, substantially free of such dust-like particles, is discharged to the atmosphere through stack 44.

Fan 32 is typically of the usual squirrel cage type driven by an electric motor, the motor and squirrel cage not being shown since they are standard fan components.

FIG. 1 shows the employment of two cyclonic separators 40, each with a stack 44 and each functioning as previously described. This arrangement permits a two-stage cleaning system, the stages acting in sequence as pipe 28 is axially advanced off of incoming pipe feeder 18.

As the pipe passes through cleaning station 22 it passes onto an elongated pipe receiving system 50. The pipe receiving system 50 is constructed substantially like incoming pipe feeder 18 and is of length to accept the longest length of metal pipe for which the pipe cleaning station is designed.

Thus, in the sequence of operation the pipe is first placed on incoming pipe feeder 18, passes through cleaning station 22 and onto pipe receiving system 50. The direction of the pipe is then reversed and pipe receiving system 50 is actuated to axially rearwardly advance the pipe back through cleaning station 22. As the pipe is advanced back through the cleaning station, it is rotated in the same way as previously described and contacted by the brushes so that the pipe is cleaned as it moves in both directions through cleaning station 22. After pipe 28 has passed rearwardly back through cleaning station 22 and back onto incoming pipe feeder 18 the external surface of the pipe has been thoroughly cleaned.

Positioned on platform 12 adjacent to incoming pipe feeder 18 is an elongated secondary pipe feeder system 52. The secondary pipe feeder system is parallel and adjacent to incoming pipe feeder 18. Means to laterally transfer a pipe from incoming pipe feeder 18 to secondary pipe feeder 52 are indicated by the numeral 54 and may be termed "pipe lateral transfer arms." After the external surface of the pipe has been thoroughly cleaned and is returned back through cleaning station 22 and back onto incoming pipe feeder 18, the length of pipe is moved from incoming pipe feeder 18 by pipe lateral transfer arms 54 onto secondary pipe feeder system 52.

Figure 2:
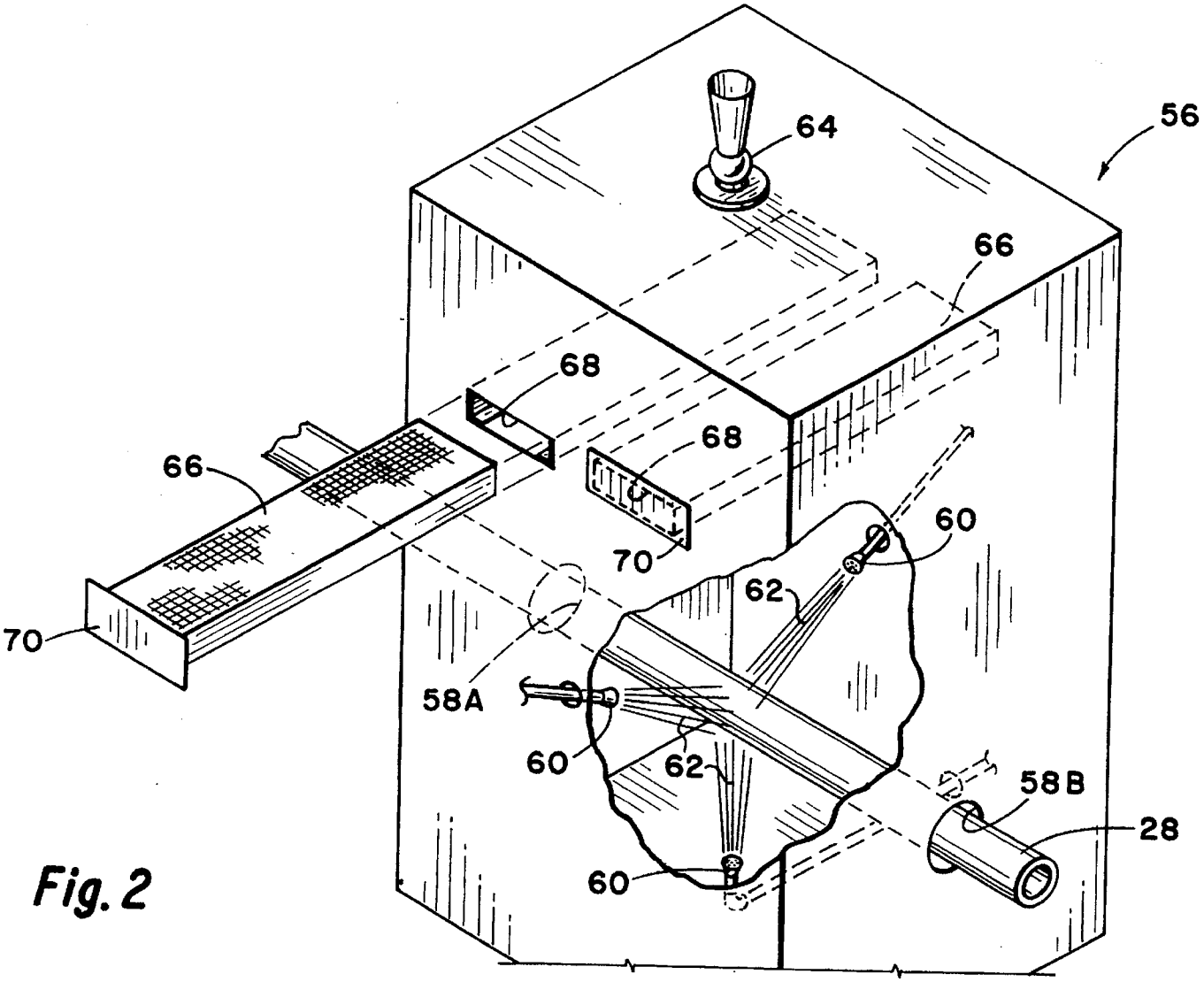
FIG. 2 is an elevational fragmentary view, shown partially cutaway, of the coating booth showing one filter removed from its position within the coating booth within an exploded arrangement.

From secondary pipe feeder system 52 the pipe passes axially through a coating booth 56, illustrated in greater detail in FIG. 2. The coating booth is an enclosure having openings 58A and 58B in the sidewalls thereof through which length of pipe 28 passes. Within coating booth 56 are nozzles 60 through which a coating is sprayed onto the pipe surface, the coating spray being indicated by the numeral 62. The nozzles 60 are arranged so as to coat the entire external surface of the length of pipe 28 as it passes through coating booth 56.

In the process of spraying coating material 62 onto the pipe, droplets and vapors therefrom tend to escape into the atmosphere. An air horn 64, that is, a high velocity blower, expels air out of coating booth 56, the air being drawn in through openings 58A and 58B. To prevent droplets and vapors from coating spray 62 from entering the atmosphere elongated filters 66 are employed. These filters are inserted into the booth through openings 68 with a cover plate 70 on the end of the filters so that when they are in position, openings 68 are closed. The interior of coating booth 56 is arranged such that air passing from the lower portion of the coating booth in which pipe 28 is positioned and in which spray nozzles 60 are placed cannot pass through air horn 64 without passing through filters 66. In this way, any entrained droplets of coating or vapors from the spray coating are intercepted by the filters and prevented from passing into the atmosphere.

Referring again to FIG. 1, positioned on platform 12 in axial alignment with the secondary pipe feeder system is an elongated outgoing pipe receiver system 72, indicated by the rollers aligned for receiving a length of pipe thereon. Thus, the outgoing pipe receiver system 72 is in direct axial alignment with the secondary pipe feeder system 52 with coating booth 56 therebetween. The outgoing pipe receiver system 72 lies parallel to and adjacent pipe receiver system 50, but in the operation of the overall system pipe is not directly transferred between pipe receiver 50 and outgoing receiver system 72.

When a length of pipe is received on outgoing pipe receiver system 72 it has been thoroughly cleaned and coated and is ready to be removed from the pipe cleaning station for storage or immediate use. Unloading arms 74 are illustrative of an apparatus that can be employed for removing a length of cleaned and coated pipe from outgoing pipe receiver system 72.

The overall pipe cleaner station, as illustrated in FIG. 1, includes basic components for control and operation of portions of the system that have been described, such as a power unit 76, control panel 78, motors 80 for driving the pipe feeders 18 and 50.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A pipe cleaning station comprising:

an elongated incoming pipe feeder for receiving a length of pipe thereon to be cleaned and having means for axially advancing lengths of pipe placed thereon;

an environmentally secure cleaning station in axial alignment with said incoming pipe feeder having means for engaging the exterior surface of a length of pipe as it is passed from said incoming pipe feeder to clean the pipe;

an elongated pipe receiving system in axial alignment with said incoming pipe feeder, with said cleaning station therebetween, and having means to axially receive a length of pipe from said cleaning station and to, subsequently rearwardly axially move the length of pipe back through said cleaning station to said incoming pipe feeder, the pipe being thus passed twice through said cleaning station to produce cleaned lengths of pipe;

an elongated secondary pipe feeder system positioned parallel to and adjacent said incoming pipe feeder having means for axially advancing cleaned pipe thereon;

means for laterally transferring cleaned pipe from said incoming pipe feeder to said secondary pipe feeder system;

an environmentally secure coating booth in axial alignment with said secondary pipe feeder system having at least one spray nozzle therein for spraying a coating on the exterior surface of a length of cleaned pipe as it is passed therethrough from said secondary pipe feeder system;

an elongated outgoing pipe receiver system in axial alignment with said secondary pipe feeder system with said coating booth therebetween, the outgoing pipe receiver system being paralleled to and adjacent said pipe receiver system, the outgoing pipe receiver system having means to axially receive a length of pipe from said coating booth, lengths of pipe being laterally removable therefrom in cleaned and coated condition.

2. A pipe cleaning system according to claim 1 including:

a cyclone separator means connected to said cleaning station for collecting material dislodged from the pipe as the pipe is passed through said cleaning station.

3. A pipe cleaning system according to claim 1 wherein said cleaning station has at least one rotating brush means for engaging the exterior surface of a length of pipe as it is passed from said incoming pipe feeder to clean the pipe.

4. A pipe cleaning system according to claim 1 wherein said incoming pipe feeder includes means to both axially advance and rotate a length of pipe placed thereon.

5. A cleaning system according to claim 1 including:

filter means within said coating booth for intercepting spray droplets from said spray nozzles to prevent the passage of spray droplets to the atmosphere.

6. A pipe cleaning system according to claim 1 including;

loading means for loading lengths of pipe onto said incoming pipe feeder.

7. A pipe cleaning system according to claim 1 wherein said pipe receiving system has means to rotate a length of pipe as it is axially rearwardly moved back through said cleaning station.

8. A pipe cleaning station according to claim 1 including unloading means for loading lengths of pipe off said outgoing pipe receiver system after the pipe has been cleaned and coated.

* * * * *

UNITED STATES PATENT AND TRADEMARK OFFICE

CERTIFICATE OF CORRECTION

PATENT NO. : 5,647,906

DATED : July 15, 1997

INVENTOR(S) : John W. MONDAY, Joseph C. OTTAVIANI and Leonard R. SMITH

It is certified that error appears in the above-identified patent and that said Letters Patent is hereby corrected as shown below:

Col. 6, line 26 (line 5 of claim 1), delete "an environmentally secure" and substitute --a-- therefor; and Col. 6, line 47 (line 26 of claim 1), delete "an environmentally secure" and substitute --a-- therefor.

Signed and Sealed this

Twenty-first Day of April, 1998

Bruce Lehman

*Attest:*

BRUCE LEHMAN

*Attesting Officer*

*Commissioner of Patents and Trademarks*